United States Patent [19]

Hayashi

[11] 4,108,132

[45] Aug. 22, 1978

[54] INTERNAL COMBUSTION ENGINE HAVING AN IMPROVED INLET VALVE ARRANGEMENT

[75] Inventor: Yoshimasa Hayashi, Yokohama, Japan

[73] Assignee: Nissan Motor Company, Limited, Japan

[21] Appl. No.: 740,235

[22] Filed: Nov. 9, 1976

[30] Foreign Application Priority Data

Nov. 10, 1975 [JP] Japan ..... 50-151719[U]

[51] Int. Cl.[2] ..... F01L 3/00

[52] U.S. Cl. ..... 123/188 S; 123/188 R

[58] Field of Search ..... 123/188 R, 188 S, 188 AA, 123/41.77; 251/360, 363; 277/22, 168, 189.5

[56] References Cited

U.S. PATENT DOCUMENTS

| | | | |
|---|---|---|---|
| 1,822,754 | 9/1931 | Smith | 123/188 S |
| 2,064,155 | 12/1936 | Fahrenwald | 123/188 S |
| 2,125,299 | 8/1938 | Krivobok | 123/188 AA |
| 2,380,821 | 7/1945 | Breeler et al. | 123/188 AA |
| 2,585,658 | 2/1952 | Keller | 251/363 |
| 2,665,675 | 1/1954 | Sheppard | 123/188 S |
| 3,165,101 | 1/1965 | Vargyai | 123/188 S |
| 3,868,953 | 3/1975 | Roll | 123/188 S |

FOREIGN PATENT DOCUMENTS

| | | | |
|---|---|---|---|
| 763,375 | 1/1955 | Fed. Rep. of Germany | 123/188 S |

*Primary Examiner*—Charles J. Myhre
*Assistant Examiner*—David D. Reynolds
*Attorney, Agent, or Firm*—Lowe, King, Price & Markva

[57] ABSTRACT

Insulating spaces or material formed on or disposed in an inlet valve seat partially insulates same to reduce the rate of heat dissipation into the cylinder head. The hotter than normal valve and valve seat insert heat and partially evaporate the HC layer adhering thereto thereby reducing the thickness thereof to a minimum.

7 Claims, 7 Drawing Figures

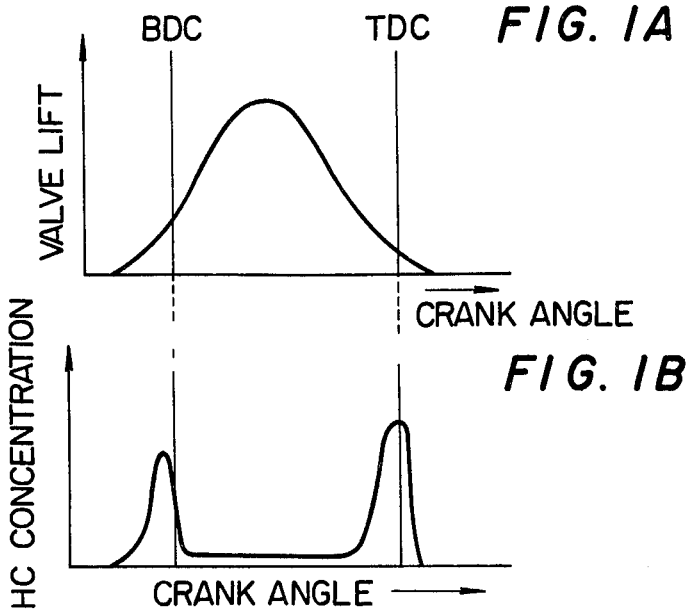
FIG. 1A
FIG. 1B
FIG. 2
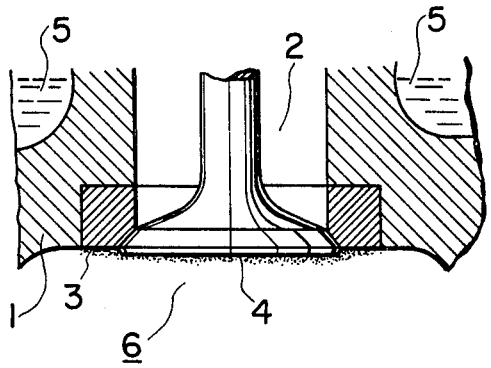
FIG. 3
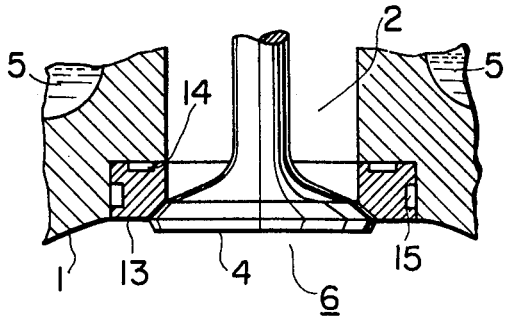

INTERNAL COMBUSTION ENGINE HAVING AN IMPROVED INLET VALVE ARRANGEMENT

This invention relates to an internal combustion engine and more particularly to a cylinder heat of an internal combustion engine having an intake valve arrangement which greatly reduces the hydrocarbon (HC) formation within the combustion chamber associated with the above mentioned cylinder head.

As is well known in the art the cylinder head of a reciprocating piston engine has a plurality of valves incorporated therein i.e., an intake valve and an exhaust valve. During the induction stroke a mixture of hydrocarbon fuel and air is inducted into the combustion chamber via the intake valve. This air/fuel mixture is, unless otherwise treated, at a temperature lower than atmospheric due the cooling effect of the fuel evaporating into the air it is intimately mixed with. Therefore, as it passes through the intake manifold and over the intake valve, the intake valve is cooled. Simultaneously heat is conducted away from the valve and valve seat insert by the coolant flowing through or about the cylinder head in close proximity to the intake valve. The combination of these two cooling effects is sufficient to reduce the temperature of the intake valve and valve seat insert to a point at which part of the fuel in the inducted charge condenses on the upper and lower sides of the intake valve. Thus, even during the compression stroke, the condensed fuel on, and in the near vicinity of the intake valve and valve seat insert fails to vaporize and reach a temperature at which ignition is possible. Hence as the flame front propagates through the combustion chamber, it is quenched in the area of the above mentioned valve. As a result of the above mentioned quench a part of the charge goes unburnt. Subsequently the HC remaining in the combusted charge is discharged into the exhaust system where it must be treated by complex apparatus disposed therein.

Measures have been taken to overcome this problem which include heating devices disposed in the induction manifold, upstream of the induction valve and/or heating devices disposed at the bottom of the intake riser. The latter, however, only heats the unvaporized fuel in the induction manifold riser, and is thus highly ineffective in overcoming the problem. The former is relatively expensive, complicated and requires a control mechanism.

At this point it should be noted that it is impossible to completely eliminate the unignitable HC layer adhering to the internal surfaces of the combustion chamber. This is due to the fact that the temperature of the internal surfaces is always below the ignition temperature of the gaseous charge to prevent so called "hot spot ignition" phenomena. Thus there is, at best, always a very thin layer of HC at a temperature which is unignitable, adhering to the inner surfaces of the combustion chamber.

It is therefore an object of this invention to provide an internal combustion engine which has an intake valve arrangement which is simple, robust and easy to install, that heats the HC adhering thereto, partially evaporates it and minimizes the thickness of the unignitable HC layer.

The invention will become better understood when taken with the accompanying drawings in which like numerals indicate like parts, and in which:

FIG. 1A is a graphical representation of the degree of the exhaust valve lift with respect to the crank angle, during the exhaust stroke of the engine;

FIG. 1B is a graphical representation of the amount of HC emitted from the combustion chamber (via the exhaust valve) with respect to the crank angle, during the exhaust phase of the engine;

FIG. 2 shows, in section, a prior art valve arrangement;

FIG. 3 shows, in section, a valve arrangement according to a first embodiment of the invention;

Figure 4:
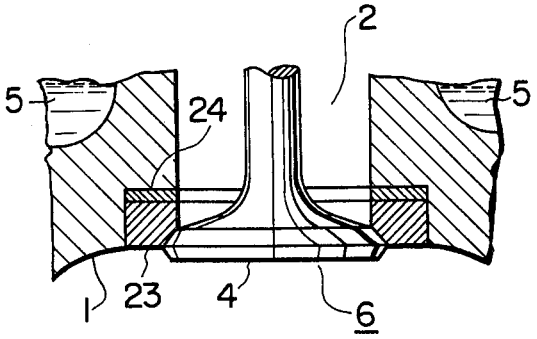
FIG. 4 shows, in section, a valve arrangement according to a second embodiment of the invention.

As clearly shown in FIGS. 1A and 1B the bulk of the HC material is emitted from the combustion chamber just after and just before the exhaust valve opens and closes, respectively. Only a small percentage of the HC (about 10%) is emitted while the exhaust valve is opened to any extent. About 40% of the HC is emitted just prior B.D.C of the power stroke and 50% emitted just as the piston reaches T.D.C. The reason for this is as follows; just before B.D.C of the power stroke, the gases are still hot and expanding, thus as the exhaust valve opens they exhaust violently therethrough, scavenging a large portion of the HC formed and or remaining in the upper region of the combustion chamber. Then as the piston approaches and reaches T.D.C a so called squish phenomena takes place. The high velocity gases produced thereby swirl violently in the remaining space to scavenge the remaining HC.

The above described scavenging of the HC has been extensively investigated by the inventors. The results of the investigations show that in fact a very large amount of the HC exhausted is formed (or not burned) in the near vicinity of the inlet valve. (It will be noted that a description of this HC formation has been given on page one.)

Referring to FIG. 2 there is shown a prior art valve arrangement in which a cylinder head 1 has a valve seat insert 3 snugly disposed in a suitably shaped bore or recess (no numeral). A valve 4 is shown seated on the valve seat insert 3 or insert as it will be referred to below. The valve 4 in the seated position seals the combustion chamber 6 from the inlet port 2. Shown adhering to the valve and insert surfaces exposed to the combustion chamber, is the condensed fuel (prior ignition). A coolant 5 is shown circulating in the near vicinity of the valve 4 and the insert 3.

With the arrangement just described the coolant 5 and the cool incoming charge entering the combustion chamber 6 via the inlet port 2 soon reduce the temperature of the valve 4 to a point at which condensation of part of the charge will take place and subsequently cause an undesirably thick layer of HC to adhere to the above mentioned valve 4 and insert 3. Thus the previously described inevitable flame front quenching causes an undesirably large amount of unburned HC to remain in the combustion chamber. Heating of the charge upstream of the inlet valve only partially overcomes the problem since the insert 3 is continuously cooled by the coolant 5. Thus in situ heating of the charge is necessary.

Referring to FIG. 3 there is shown a first embodiment of the invention in which the components are the same as in FIG. 2 other than the insert 13. The insert 13 has two grooves or recesses 14 and 15 formed in the surfaces contacting the cylinder head proper. These grooves serve to reduce the heat conducting surface area of the insert actually in contact with the cylinder head. As a result, the rate of heat dissipation from the insert into the cylinder head and coolant is considerably reduced. Accordingly, the temperature of both the insert and the associated valve, rises. Thus the relatively cool charge contacting the hot valve and insert is heated, reducing the thickness of the HC layer adhering thereto. Simultaneously as the condensed fuel evaporates the valve is cooled to a point at which pre-ignition does not occur.

FIG. 4 shows a second embodiment of the invention, and as in the case of the first embodiment all components other than the insert are the same. In this case the insert 23 has an annular member or plate 24 which serves as an insulator disposed between one of its two cylinder head contacting surfaces and the cylinder head. This arrangement serves to reduce the rate at which heat is dissipated into the cylinder head and thereby achieves the same effect as the first embodiment.

It will be noted that if desired only one of the grooves 14 or 15 may be formed. It is of course possible to dispose an insulating material in the groove or grooves or as shown in FIG. 4, replace the grooves completely with a material having a low thermal conductivity, such as stainless steel.

Figure 5:
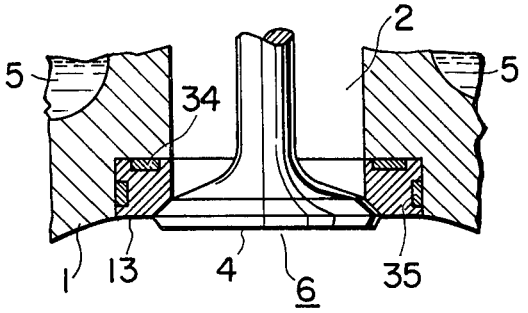
FIG. 5 shows, in section, a variation of the first embodiment of the invention.
Figure 6:
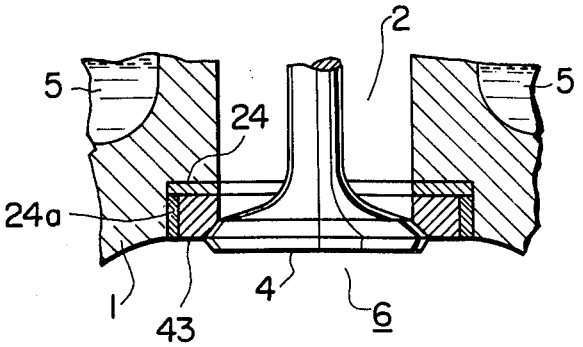
FIG. 6 shows, in section, a variation of the second embodiment of the invention.

FIGS. 5 and 6 show variations of the first two embodiments of the invention. As mentioned above it is possible to replace the air space formed by the groove or grooves in the insert 13 with a material having a low thermal conductivity. FIG. 6 shows the insert 43 totally insulated from the cylinder head wherein a second annular ring **24*a* is which serves as an insulator disposed about the outer periphery of the insert 43**.

It will be obvious to those skilled in the art that other variations other than those described above are possible without departing from the spirit and scope of the invention. Further it is obvious that the invention is extremely simple, yet serving to eliminate a major portion of the HC formed in the combustion chamber. Moreover the invention serves to greatly reduce the treatment load placed on post combustion noxious gas treating devices such as after burners or catalytic converters.

What is claimed is:

1. In an internal combustion engine, a cylinder head having an inlet port which opens into a combustion chamber, a valve seat insert securely disposed in an orifice of the inlet port, and an inlet valve having a head seatable on said valve seat insert to prevent fluid communication between the combustion chamber and the inlet port, the improvement comprising:

thermal insulation means arranged between said valve seat insert and said cylinder head and adapted to insulate a sufficient portion of the interface defined between the valve seat insert and the cylinder head so that during the operation of the internal combustion engine the transfer of heat from the valve seat insert and the valve head to the cylinder head is limited to raise the temperature of the valve seat insert and the valve and to reduce the thickness of the layer of air-fuel mixture in contact with and in the immediate vicinity of the surfaces of the valve seat insert and the valve head exposed to the interior of the combustion chamber.

2. An internal combustion engine as claimed in claim 1 wherein said thermal insulation means comprises a pair of grooves formed in said valve seat insert, each groove being arranged in a leg of the interface defined between said valve seat insert and said cylinder head.

3. An internal combustion engine as claimed in claim 2 wherein said grooves are filled with air.

4. An internal combustion engine as claimed in claim 2 wherein said grooves are filled with a stainless steel having a low thermal conductivity.

5. An internal combustion engine as claimed in claim 1 wherein said thermal insulation means comprises an annular plate of a stainless steel having a low thermal conductivity, said plate being dimensioned to completely overlay one leg of the interface of said valve seat insert and separate said leg from said cylinder head.

6. In an internal combustion engine, a cylinder head having an inlet port which opens into a combustion chamber, a valve seat insert securely disposed in an orifice of the inlet port, an inlet valve having a head seatable on said valve seat insert to prevent fluid communication between the combustion chamber and the inlet port, the improvement comprising:

said valve seat insert being formed with a pair of grooves, each of said grooves being formed along a different leg of the interface defined between the valve seat insert and the cylinder head, the arrangement being such that the transfer of heat from the valve seat insert and the valve head to the cylinder head is limited to raise the temperature of the valve seat insert and the valve head during the operation of the internal combustion engine to minimize the thickness of the layer of air-fuel mixture in contact with and in the immediate vicinity of the surfaces of the valve seat insert and the valve head exposed to the interior of the combustion chamber, said layer being at a temperature at which combustion thereof is not possible.

7. In an internal combustion engine, a cylinder head having an inlet port which opens into a combustion chamber, a valve seat insert securely disposed in an orifice of the inlet port, an inlet valve having a head seatable on said valve seat insert to prevent communication between the combustion chamber and the inlet port, the improvement comprising:

an annular plate of stainless steel having a low thermal conductivity disposed between said valve seat insert and said cylinder head, said plate being dimensioned to completely overlay one leg of the interface defined between the valve seat insert and the cylinder head to separate said leg from contact with said cylinder head and reduce the amount of heat transferred from the valve seat insert and the valve head to the cylinder head to raise the temperature of said valve seat insert and said valve head during the operation of the internal combustion engine and minimize the thickness of the layer of air-fuel mixture which is in contact with and in the near vicinity of the surfaces of the valve seat insert and the valve head and which is at a temperature below the ignition temperature of the mixture.

* * * * *